United States Patent [19]

Dibert

[11] Patent Number: 4,906,889

[45] Date of Patent: Mar. 6, 1990

[54] SPARK PLUG CONSTRUCTION WITH TEMPERATURE RESPONSIVE GROUND WIRES

[76] Inventor: Fred Dibert, 2617 Prospect St., Flint, Mich. 48504

[21] Appl. No.: 208,465

[22] Filed: Jun. 20, 1988

[51] Int. Cl.[4] ..... H01T 13/32

[52] U.S. Cl. ..... 313/126; 313/141; 313/142; 313/144

[58] Field of Search ..... 313/125, 126, 132, 141, 313/142, 144, 140; 123/169 EL

[56] References Cited

U.S. PATENT DOCUMENTS

| | | | |
|---|---|---|---|
| 898,427 | 9/1908 | Benoist | 313/140 |
| 1,298,368 | 3/1919 | Metzinger | 313/140 |
| 1,318,529 | 10/1919 | Berlioz | 313/142 |
| 1,345,765 | 7/1920 | Hadrich | 313/140 |
| 1,417,876 | 5/1922 | Wood | 313/142 |
| 1,465,869 | 8/1923 | Samland et al. | 313/142 |
| 1,468,031 | 9/1923 | Peterson | 313/142 |
| 1,486,459 | 3/1924 | Rudolph | 313/140 |
| 1,537,938 | 5/1925 | Dumbovich | 313/142 |
| 1,593,770 | 7/1926 | Lang | 313/140 |
| 1,626,081 | 4/1927 | Hadrich | 313/140 |
| 1,845,407 | 2/1932 | Gibilaro | 313/140 |
| 1,989,670 | 2/1935 | Anthony | 123/169 |
| 1,992,071 | 2/1935 | Healey | 123/169 |
| 2,470,033 | 5/1949 | Hensel | 313/142 |
| 3,970,885 | 7/1976 | Kasima | 313/141 |
| 4,023,058 | 5/1977 | Lara et al. | 313/141 |

*Primary Examiner*—Donald J. Yusko
*Assistant Examiner*—Michael Horabik
*Attorney, Agent, or Firm*—Learman & McCulloch

[57] ABSTRACT

A spark plug having a metal shell accommodating a dielectric core through which an electrode extends and terminates at one end in a tip spaced by a spark gap from an overlying ground wire that is bent between its ends and joined to the shell. That surface of the ground wire which confronts the electrode is grooved to enlarge its area and enable the wire to react like a bimetallic element in response to changes in its temperature and vary the size of the spark gap.

17 Claims, 1 Drawing Sheet

SPARK PLUG CONSTRUCTION WITH TEMPERATURE RESPONSIVE GROUND WIRES

Figure 1:
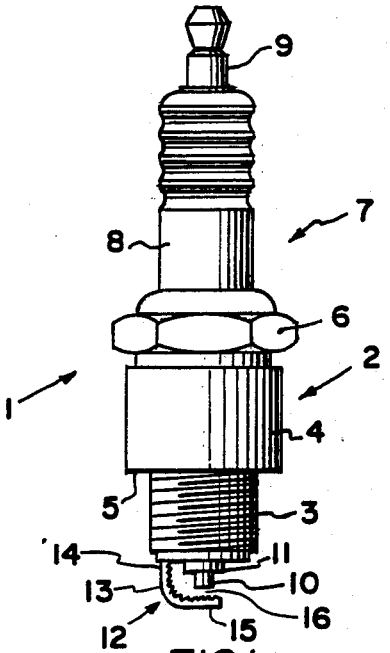

This invention relates to a spark plug of the kind adapted to be utilized in an internal combustion engine.

BACKGROUND OF THE INVENTION

A conventional spark plug used in an internal combustion engine has a metallic shell adapted to be fitted into an opening in communication with a cylinder. The shell accommodates a ceramic or other dielectric body through which extends a first electrode. One end of the electrode is coupled to an ignition system, whereas the other end of the electrode terminates in a tip which is exposed to combustible vapors present in the cylinder. A second electrode or ground wire has one end thereof overlying the tip of the first electrode and is spaced therefrom to provide a gap of predetermined size. The ground wire is bent between its ends and has its other end secured to the shell.

The gap between the electrode tip and the ground wire is variable, but it usually is preset to provide the most efficient fuel ignition when the engine is at normal operating temperature. For example, the spark gap may be set at about 0.045 inch which provides for good ignition when the engine is hot. When the engine is cold, however, it is more difficult to generate a spark between the electrode tip and the ground wire than is the case when the engine is hot. Consequently, it is more difficult to start a cold engine than a warm engine.

An object of the invention is to provide a spark plug which overcomes or minimizes the difficulty in starting cold engines, but without detracting from the efficiency of the engine when it is at operating temperature.

SUMMARY OF THE INVENTION

A spark plug constructed in accordance with the invention comprises a conventional metallic shell adapted to be threaded into an opening in communication with a cylinder of an internal combustion engine. The shell supports a conventional ceramic or other dielectric body through which extends an ignition electrode terminating at that end of the spark plug which is within the cylinder in an exposed tip. A ground wire is bent between its ends to form a substantially L-shaped elbow. One end of the ground wire is secured to the shell and the other end overlies and is spaced from the electrode tip to form a spark gap.

That surface of the ground wire which is at the inside of the elbow, i.e., the surface which confronts the ignition electrode, is provided with a plurality of transversely extending, longitudinally spaced grooves which are rolled into the wire rather than being cut. Roll forming of the grooves distorts the grain of the material from which the ground wire is formed and imparts to the ground wire expansion and contraction characteristics similiar to that of a bimetallic element.

The construction is such that, when the bent ground wire is heated, it tends to straighten, whereas when it cools, it returns to its initial bent configuration. It thus is possible to preset the spark gap between the electrode tip and the overlying end of the ground wire to a relatively low value, thereby facilitating the generation of parks when the engine is cold. As the engine warms and raises the temperature of the ground wire, the latter will react to enlarge the spark gap so as to provide for more efficient ignition. When the engine cools, the ground wire will return to its preset condition.

THE DRAWINGS

Figure 2:
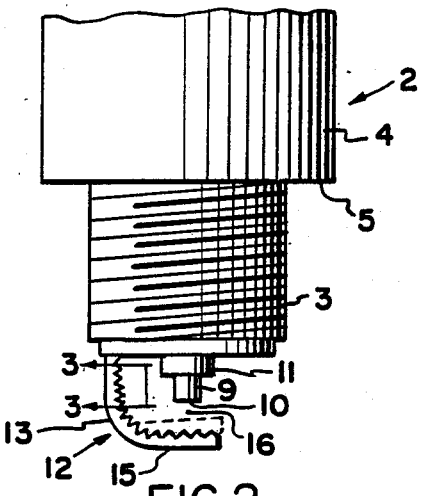
Figure 3:
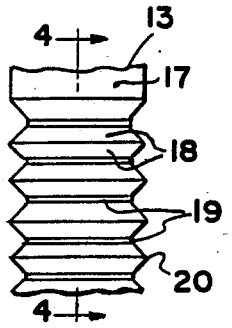
Figure 4:
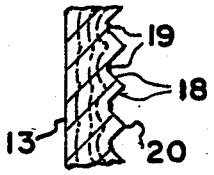

A spark plug constructed in accordance with a preferred embodiment of the invention is illustrated in the accompanying drawings, wherein:

FIG. 1 is an elevational view of a spark plug at normal operating temperature;

FIG. 2. is a fragmentary, enlarged elevational view of the lower end of the spark plug shown in FIG. 1;

FIG. 3 is a fragmentary, greatly enlarged view of the ground wire taken along the lines 3—3 of FIG. 2; and FIG. 4 is a sectional view taken along the lines 4—4 of FIG. 3.

THE PREFERRED EMBODIMENT

A spark plug 1 constructed in accordance with the invention comprises a metal shell 2 having a threaded shank 3 adapted to be threaded into an opening that is in communication with a cylinder of an internal combustion engine. The shell includes a body 4 terminating at its lower end in a shoulder 5 that is adapted to bear upon a gasket, as is conventional. The shell also includes a faceted head 6 to facilitate rotation of the shell.

The spark plug also includes a ceramic or other dielectric body 7 having a core 8 provided with a bore through which extends an ignition electrode 9 terminating at its lower end in a flat tip 10 which protrudes a short distance from the lower end 11 of the core 8 so as to be exposed to the contents of the cylinder.

A second electrode 12 comprises an electrically conductive ground wire 13 that is bent between its ends to an L-shaped or elbow configuration., One end 14 of the ground wire is secured to the shell shank 3, whereas the other end 15 overlies and is spaced from the electrode tip 10 by a gap 16.

The material from which the ground wire 13 is formed preferably is thermally sensitive nickel or a nickel-rich alloy of the kind conventionally used in the manufacture of spark plugs and may be either cylindrical or quadrangular in cross section. In any event, the ground wire has a surface 17 which confronts the electrode 9 and such surface is provided with a plurality of transversely extending, longitudinally spaced grooves 18.

The grooves 18 are formed by a known rolling process, rather than being cut. Rolling of the grooves thus enables the grain structure of the wire-forming material to be distorted, as is indicated in FIG. 4, rather than severed. The roll dies which form the grooves 18 preferably are so configured that the bases 19 of the grooves 18 are flat, rather than V-shaped However, it is preferred that the free edge 20 of each groove be sharp so as to define sharp edges which promote sparking.

The thickness of the ground wire 13 typically may be 0.055 inch, and the width and depth of each groove may be 0.105 and 0.013 inch, respectively. The number of grooves per inch may be twenty-four.

To condition the spark plug for use, the ground wire 13 is bent, when the spark plug is cold, so that the spark gap 16 between the tip 10 and the wire end 15 is relatively narrow, such as about 0.035 inch. This is the condition of the ground wire shown in dotted lines in FIG. 2.

The relatively narrow gap will facilitate starting of a cold engine. As the engine warms, however, the temperature of the ground wire also will increase. As a result of the grooving of that surface 17 of the ground wire which confronts the electrode 9, such surface has a greater area than the opposite surface. Accordingly, the grooved surface 17 will expand more than the opposite surface, similar to a bimetallic strip, thereby causing the arc on which the ground wire 13 is bent to increase. Increasing the arc of the bend will cause the end 15 to move in a direction away from the electrode tip 10, as shown in full lines in FIG. 2, thereby increasing the dimension of the spark gap 16. Normally, the maximum movement of the ground wire 15 is about 0.010 inch, thereby enabling the gap size to increase from about 0.035 inch to about 0.045 inch.

The rolling of the grooves 18 so as to distort, rather than cut, the grain structure of the ground wire material, coupled with the relatively flat bases 19 of the grooves 18, promotes the bimetallic-like action of the ground wire in response to temperature changes.

For purposes of economy in manufacturing, the ground wire 13 may be grooved over its entire length. However, it is possible to provide the grooves only in the zone of the bend in the ground wire without adversely effecting the bimetallic-like action of the ground wire.

The disclosed embodiment is representative of a presently preferred form of the invention, but is intended to be illustrative rather than definitive thereof, the invention is defined in the claims.

I claim:

1. A spark plug construction comprising an electrically conductive shell; a dielectric body accommodated in said shell; an electrode carried by said body and terminating in an exposed tip; and an electrically conductive, thermally sensitive ground wire, said wire being bent between its ends to form an elbow having one end overlying and spaced from said tip by a gap and its other end connected to said shell with one surface of said wire confronting said electrode, said wire having in said one surface only and at least at said elbow a plurality of transversely extending spaced apart grooves, whereby changes in the temperature of said wire cause the latter to flex and vary the size of said gap.

2. The construction according to claim 1 wherein said wire is substantially L-shaped in configuration.

3. The construction according to claim 1 wherein said grooves are roll formed in said wire.

4. The construction according to claim 1 wherein said wire has a continuous grain structure from end to end, said grain structure being deformed adjacent said surface to conform substantially to the configuration of said grooves.

5. The construction according to claim 1 wherein said grooves are formed in said wire over substantially its entire length.

6. The construction according to claim 1 wherein said grooves are formed in said wire only adjacent the bend therein.

7. The construction according to claim 1 wherein that surface of said wire which confronts said electrode is substantially flat except for said grooves.

8. The construction according to claim 1 wherein said wire is substantially cylindrical except for such surface.

9. The construction according to claim 1 wherein said wire is formed of metal.

10. The construction according to claim 9 wherein said metal includes nickel.

11. The construction according to claim 1 wherein said wire is quadrangular in cross section.

12. In a spark plug construction having a dielectric body supported by an electrically conductive shell, an electrode carried by said body and having a tip exposed at one end of said body, and a thermally sensitive, electrically conductive wire having one end thereof overlying said tip and being spaced therefrom by a gap, said wire being bent between its ends to form an elbow having a surface confronting said electrode and having its other end secured to said shell, the improvement wherein said wire has a plurality of transversely extending, spaced apart grooves therein at least in the zone of said elbow and only in that surface of said wire which confronts said electrode.

13. The construction according to claim 12 wherein said grooves are formed in said surface of said wire over substantially its entire length.

14. The construction according to claim 12 wherein said grooves are roll formed in said surface of said wire.

15. The construction according to claim 12 wherein said wire has a continuous grain structure from end to end, said grain structure being deformed adjacent said surface to conform substantially to the configuration of said grooves.

16. The construction according to claim 12 wherein said surface of said wire which confronts said electrode is substantially flat except for said grooves.

17. The construction according to claim 16 wherein said wire is formed of nickel-rich metal.

* * * * *